United States Patent [19]

Long et al.

[11] Patent Number: 4,768,591

[45] Date of Patent: Sep. 6, 1988

[54] STEAM QUALITY APPARATUS

[75] Inventors: Stephen L. Long; George T. West, both of Houston, Tex.

[73] Assignee: Texaco Inc., White Plains, N.Y.

[21] Appl. No.: 20,833

[22] Filed: Mar. 2, 1987

[51] Int. Cl.[4] ..... E21B 49/08; G01N 1/12

[52] U.S. Cl. ..... 166/166; 73/863.21; 73/864.63; 166/169

[58] Field of Search ..... 166/169, 168, 167, 165, 166/164, 162, 68, 72, 264, 166; 73/155, 863.21, 863.52, 863.53, 863.73, 864.63

[56] References Cited

U.S. PATENT DOCUMENTS

| | | | |
|---|---|---|---|
| 3,249,054 | 5/1966 | Hill | 166/68 X |
| 3,459,263 | 8/1969 | Drivet | 166/165 |
| 3,934,469 | 1/1976 | Howard et al. | 166/264 X |
| 3,981,189 | 9/1976 | Howard et al. | 166/264 X |
| 4,088,187 | 5/1978 | Howard et al. | 166/169 X |
| 4,254,830 | 3/1981 | Garney et al. | 166/169 X |

FOREIGN PATENT DOCUMENTS 161006 3/1964 U.S.S.R. .

*Primary Examiner*—Stephen J. Novosad

*Attorney, Agent, or Firm*—Robert A. Kulason; James J. O'Loughlin; Robert B. Burns

[57] ABSTRACT

A downhole steam sampler for collecting the liquid phase content of a steam flow, immediately prior to the latter being injected into a substrate surrounding a hole or well. A reservoir within the sampler separates and retains the liquid phase while permitting the vaporous phase to pass. Detent means cooperates with a pair of spaced apart flow control valves to permit said valves to be closed simultaneously when the steam sampling operation is completed. The detent means is actuated in response to withdrawal of the sampler from the well, an action which displaces an externally positioned sleeve.

9 Claims, 3 Drawing Sheets

STEAM QUALITY APPARATUS

BACKGROUND OF THE INVENTION

In the production of carbonaceous products such as crude oil and the like, the viscosity of the latter and the condition of the subterranean reservoir in which it is held, often demand that some form of enhancement be utilized. Among the more common forms of enhancement is the injection of steam into the substrate at a sufficient pressure to penetrate the latter and to fluidize the carbonaceous product. The injected steam also forms a pressurized barrier to drive production fluids in a particular direction toward a producing well or wells.

It is desirable in conducting such a steaming operation, to determine the quality of the steam as it enters the substrate. The latter can be at a location any depth along the borehole, or well.

The determination of steam quality is an economic expedient since the steam will be delivered to the borehole upper end from a source, in a known condition. By the time it flows through the well bore however, and is in position to enter the substrate, the quality will generally be reduced. Without an accurate determination of quality, it is difficult to estimate the amount of heat being delivered to the substrate.

In brief, an oil field steam generator normally produces "wet steam". The steam is not 100% vapor; but does contain a liquid phase. Steam quality is a measure of the mass of vapor to the total mass of the steam. It is therefore accurate to refer to the vapor phase or the liquid phase of wet steam when quality is being considered.

Generally speaking, feed water to a steam generator contains a certain amount of dissolved solids such as salt, i.e. sodium chloride. When the water is turned into wet steam the sodium chloride cannot be contained in the vapor phase, it must be carried into the liquid phase. Therefore the salt content becomes concentrated in the liquid phase.

The higher the steam quality (i.e.: more vapor phase to liquid phase), the more concentrated the salt content becomes. To measure steam quality, the sodium chloride content of a sample of the liquid phase is ratioed to the sodium chloride content of the feed water. The amount of condensation that occurs does not affect the presently disclosed tool or steam sampler. This apparatus functions to measure the amount of condensation (i.e. loss or reduction of steam quality).

The prior art has disclosed downhole steam samplers which have been successfully utilized. These are used generally for withdrawing a sample of the liquid phase of steam from a steam flow being injected into a wall. The sample, when withdrawn from the well, can be analyzed for its chloride ion count as an aid toward establishing an accurate determination of the quality of the steam as it enters the substrate.

In the present arrangment, a steam sampler is disclosed which is both durable in structure and relatively simple to operate particularly for actuating the steam flow control valves. The sampler is comprised primarily of an elongated casing which is lowered by a wire line to a particular position within a well or borehole. The sampler casing includes an inlet at the upper end for admitting a steam flow at high pressure and temperature. A discharge opening at the casing lower end directs the pressurized flow into the well and thence into the contiguous subterranean reservoir.

The steam sampler incorporates a fluid separator which permits the liquid phase content to fall by gravity into a container, reservoir or receptacle. The vaporous segment will continue downwardly and be directed from the sampler's discharge opening.

The respective flow control valves are provided with a spring biased valve actuator rod which functions to adjust the valves from open to closed positions. The actuator rod is initially pre-set for a steam treating operation with the valves open, the rod being maintained in pre-set position by a first restraining detent.

While a flow of steam is passing through the sampler casing during a desired time period, the liquid phase will accumulate in the collecting reservoir. At the end of said time period, steam flow through the sampler is terminated to permit the sampler to be drawn from the well.

Closing of the sampler's flow control valves to discontinue steam flow therethrough is accomplished through a sleeve carried on the sampler. The sleeve includes a plurality of radially displaceable arms which are held in position by a second detent.

It is therefore an object of the invention to provide a steam sampler of the type contemplated which is responsive to surface induced actuation for closing steam flow control valves.

A further object is to provide a steam sampler that functions to discontinue steam flow therethrough in response to withdrawal of the sampler from a well.

A still further object is to provide a steam sampler having a valve triggering mechanism external of the sampler casing.

DESCRIPTION OF THE DRAWINGS

FIG. 6 is an enlarged segmentary view of another portion of FIG. 2.

Referring to FIG. 1, a well bore or hole 10 is illustrated as formed into a substrate 11. The latter is characterized by a reservoir holding a hydrocarbon fluid which is to be removed through a thermal enhancement procedure. Well 10 following the accepted practice, is formed by a series of vertical casings 12. The inner casing extends downwardly through one or more productive levels at which the casing is perforated, and which levels are to be treated by steam injection from a pressurized source 20.

A steam sampler 13 is shown suspended by a wire line 14 or other member which can be controlled from the ground. Thus, vertical positioning of the sampler in the well casing can be regulated to treat a particular level.

Figure 2:
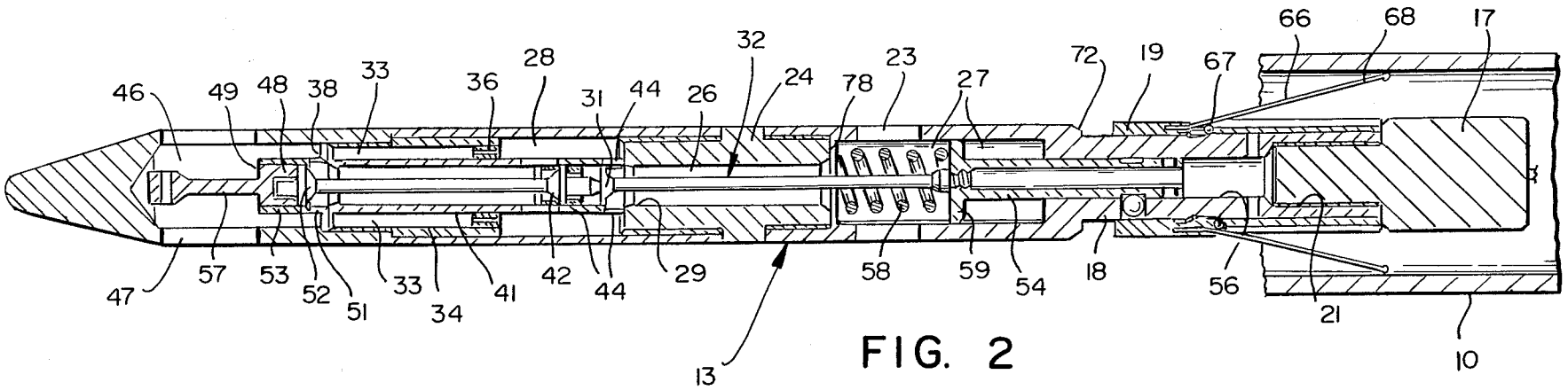
FIG. 2 is an enlarged cross-sectional view of the sampler shown in FIG. 1.
Figure 3:
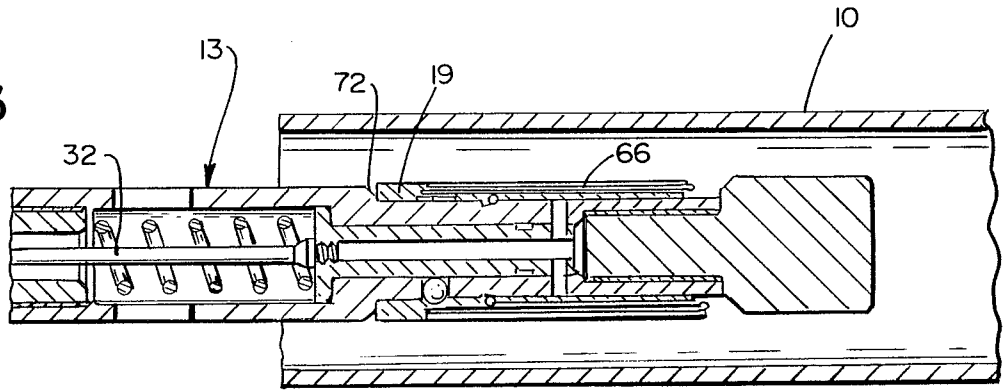
FIG. 3 is similar to FIG. 2.
Figure 5:
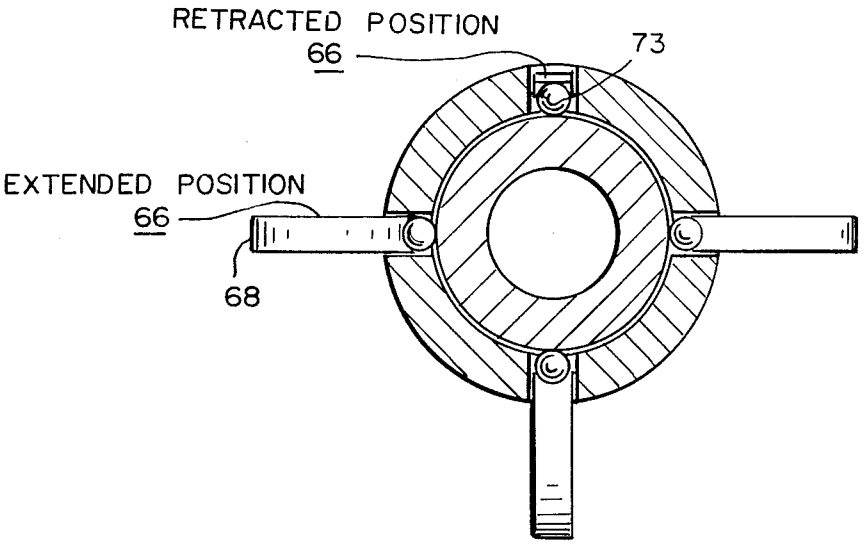
FIG. 5 is a cross-section taken along line 5—5 in FIG. 4.

Referring to FIGS. 2 and 5 steam sampler 13 is comprised of an elongated steel casing 16 having opposed upper and lower connected sections which can be formed of a plurality of discrete, axially aligned tubular members. Casing 16 is capable of being suspended vertically in well 10 by wire line 14 to permit vertical movement thereof powered by a wire line winch 15 or by a sucker rod coupling 17, as shown in FIG. 2, which threadably engages the sampler upper end.

Casing 16 is comprised primarily of an elongated tubular member characterized by a relatively constant outside diameter. The upper end of said tubular member, is provided with a constricted guide section 18 having a relatively smooth surface to slidably register a sleeve 19 thereon.

The upper end of casing 16 is further provided with an internal cavity 21 which threadably receives an adapter member or sucker rod coupling 17. The latter, when seated properly, furnished an end abutment for sleeve 19 as the sleeve is displaced in an upward direction in anticipation of the steam sampler being used.

Casing 16 defines an elongated internal steam flow passage. Said internal passage is provided with an inlet opening 23 at the upper end which receives high pressure steam that has been injected into well 10 from source 20.

A connector 24 within casing 16 includes an axial passage 26 through which steam is channeled from inlet chamber 27, to a downstream intermediate or separation chamber 28.

Insert or connection member 24 is provided at its downstream end with a valve face 29 at the exit of passage 26. Said face is conformed to receive a corresponding seating surface 31 carried on valve actuator rod 32.

Connector 24 includes an axial extension 41 having an inner cylindrical surface which slidably registers valve guide 42 and conical seating surface 31. Radial ports 44 formed in valve extension 41 allow access for steam flow which passes through the open valve.

Casing 16 central steam passage is further provided with a liquid reservoir 33 defined by an elongated tubular 34 having an upper end 36 which engages valve extension 41 to be positioned in place. Passages 44 allow steam flow into intermediate or separation chamber 28 and thence into reservoir 33. In the latter, the steam liquid phase will be subsequently raised to the surface and analyzed.

The lower end of the casing 16 is provided with a recess in which the end of tubular 34 is received. The latter is provided at its upper end with one or more transverse holes 37 which allow pressurized steam, having the liquid phase separated therefrom, to proceed through the lower end of the casing steam flow passage. It is thereafter passed into discharge chamber 46 through the lower or discharge valves 51–53.

The lower end of recess 38 includes a valve guide extension 48 in which the valve element 49 is slidably retained. Said guide extension 48 includes a plurality of lateral passages 51 to allow the steam to discharge from the axial elongated passage, and flow into the discharge chamber 46.

Steam flow through casing 16 axial passage, is regulated between full flow and no flow, by at least one, and preferably as here shown, by a plurality of aligned valves. Two such valves are thus positioned within the elongated steam passage, being spaced longitudinally apart. Steam flow is thereby controlled between zero and maximum flow through the respective control valves as the latter are adjusted between fully opened and fully closed positions in response to movement of the common valve actuator rod 32.

Valve actuator rod 32 is provided at its upper end with a guide shank 54 which is slidably registered within central port 56 of the casing guide section 18. Shank 54 is adapted to slidably and reciprocally move within passage 56 to effectuate the simultaneous opening-closing of the respective flow control valves.

Enlarged hub 59, which depends from shank 54 is slidably registered in chamber 27 and forms a shoulder for spring 58 which is compressed into the lower section of chamber 27.

Functionally, the flow control valve at casing 16 lower end is structurally similar to the casing upper flow control valve and includes a guide surface slidably received within the extension 48. Seating element 53 carried on valve actuator rod 32 engages the adjacent valve seat 52 to close the valve, when actuator rod 32 is released from its preset, open valve condition.

The lower end of valve actuator rod 32 further includes a tang 57 which extends downwardly into discharge chamber 46. Said tang functions to allow actuator rod 32 to be pulled downwardly, or preset against the resisting force of spring 58. Actuator rod 32 will be maintained in downward, and open valve position by the action of one or more detent mechanisms as hereinafter noted.

Referring to FIGS. 2 and 5, a first detent means at the steam sampler upper end, includes a detent groove 61 which is formed in the periphery of actuator rod shank 54. A detent ball 62 is movably positioned within a lateral detent cavity 63 formed into the wall of the casing guide section 18. Said ball 62, when in the preset position, is displaceably received in detent groove or channel 61. Acutator rod 32, when set and locked in the lowered position, will maintain both flow control valves in open position.

When so positioned, detent ball 62 is held in place against the inner surface of sleeve 19 only when the latter is adjusted to the upper or retracted position as shown in FIGS. 2 and 5.

Figure 1:
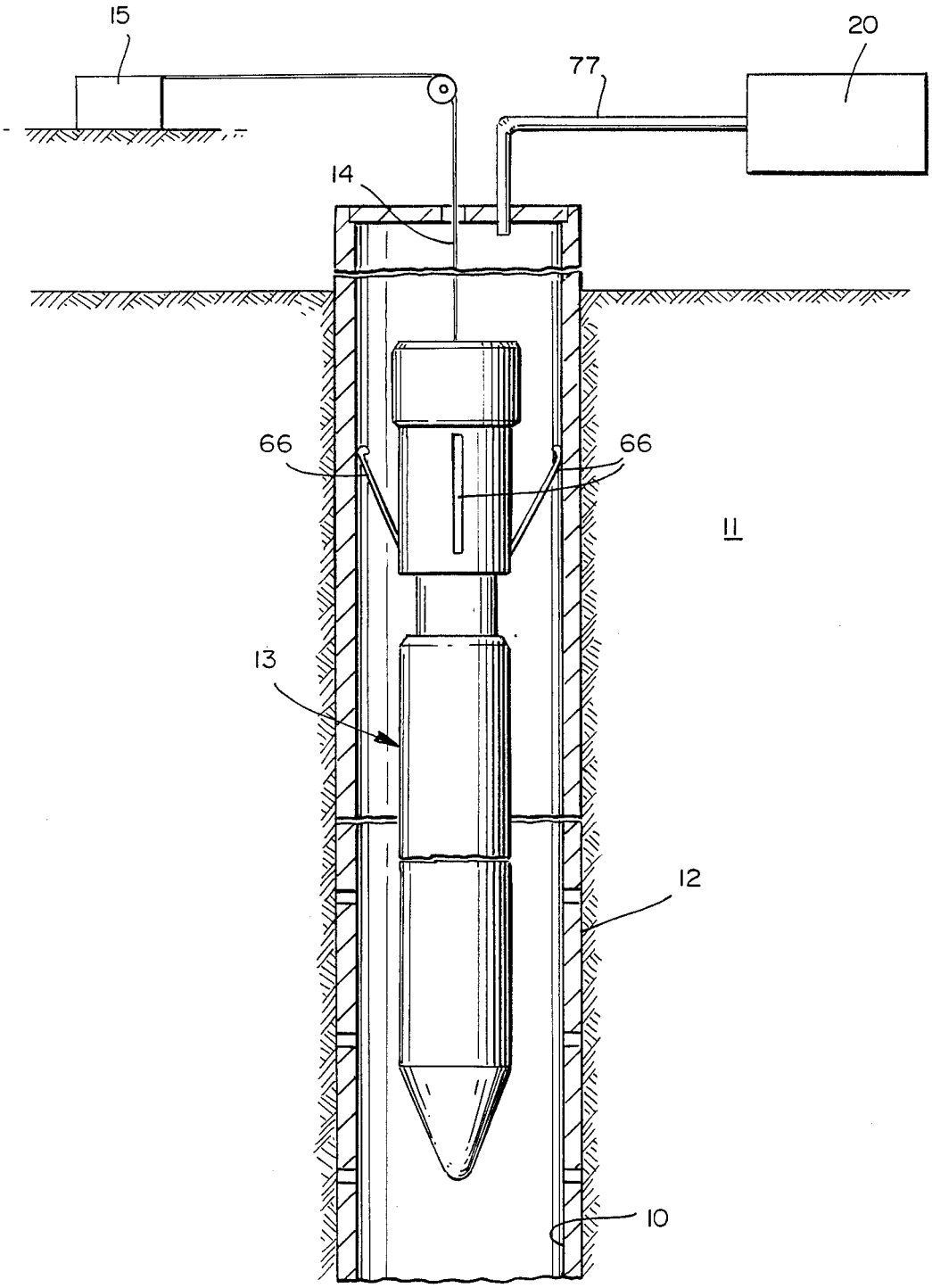
FIG. 1 is an environmental view in cross-section of the instant steam sampler apparatus in a well.
Figure 4:
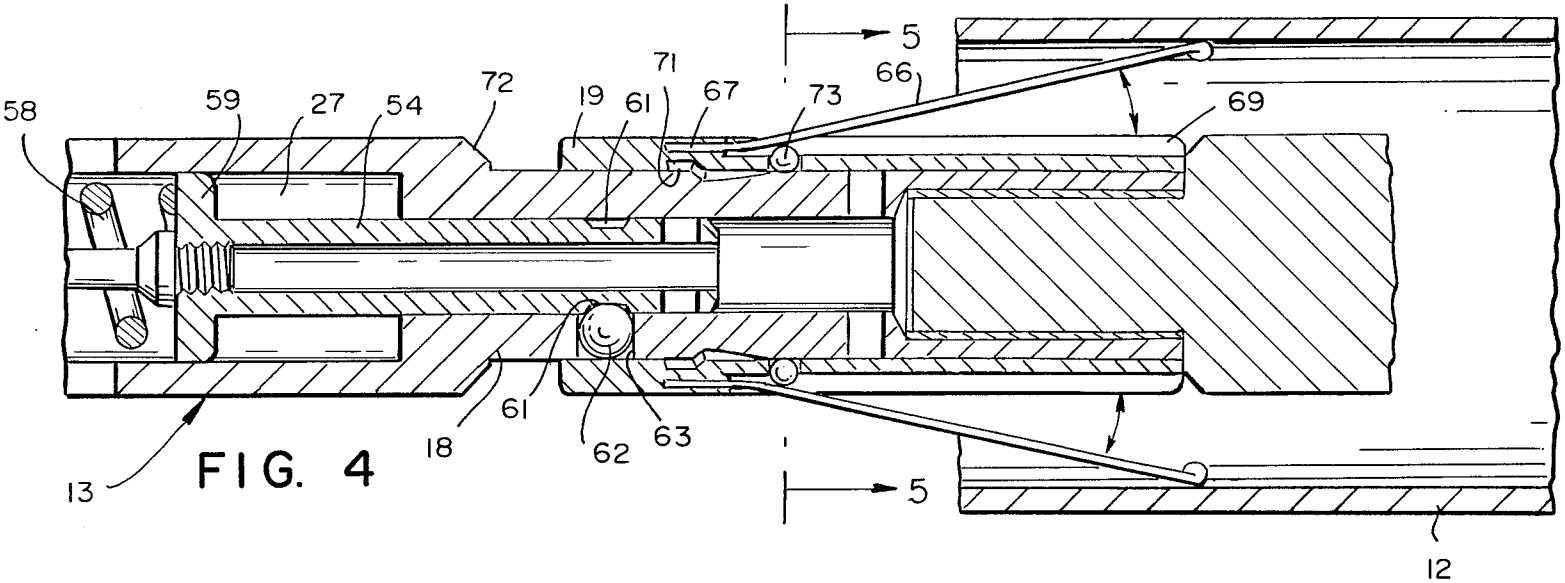
FIG. 4 is an enlarged segmentary view of a portion of in FIG. 2.

Referring to FIG. 4, sleeve 19 is comprised of a generally cylindrical member having a plurality of longitudinally extending grooves 64, each of which is adapted to receive a retractable arm 66. As shown in FIGS. 1 and 6, the numbers of longitudinal grooves 64 in sleeves 19 is preferably such that when the respective retractable arms 66 are in expanded position, they will engage the adjacent casing 12 wall, to maintain the sampler 13 in a centralized position relative to the casing.

Each retractable arm 66 is comprised of an elongated metallic spring-like, member having an inner end 67 retained within a receiving slot or groove 64 to permit the entire arm to be pivoted about said fixed end 67. This spring action urges the arm into an outward or expanded position having the ends thereof in engagement with the remote contact end 68 touching casing 12.

The inner or sliding surface of sleeve 19 is provided with a first detent groove 71 which, when the sleeve 19 is set in the retracted position, is spaced longitudinally from first detent ball 62. However, when sleeve 19 is urged forward such that the leading edge thereof contacts casing shoulder 72, first detent ball 62 will register in the peripheral groove 71. Ball 62 will thereby be displaced from its retaining position on actuator rod 32.

Release of actuator rod 32 allows compression spring 58, which is seated on panel 78, to urge the entire actuator rod into the upper position. Thus, both flow control valves will close simultaneously.

The plurality of arms 66 as shown in FIGS. 4 and 5 are in the outward position and held there by a detent member carried in a detent cavity formed in the sleeve 19 wall. A detent member such as a second ball 73 is carried within detent cavity 74, and bears against the underside of arm 66. The latter is thereby urged outwardly with the contact end 68 in engagement with the casing 16 inner wall.

A longitudinal detent groove 76 is formed in the outer surface of casing guide section 18, adjacent to second detent ball 73. Thus, as sleeve 19 is forced toward its downward position into engagement with casing shoulder 72, second detent ball 73 will register in peripheral detent groove 76. Ball 73 will thereby be urged inwardly by the spring-like arm 66, which returns to its normal position registered within elongated arm cavity 64.

Operationally, when the sampler 13 is to be lowered in a vertical disposition into a well casing 12 on a wire line 14, the unit is initially set with both flow control valves in open position. This setting is done most readily when the sampler is at ground level, by drawing valve actuator rod 32 into the downward or restricted position. First detent ball 62 will thereby engage the actuator rod shank groove 61 to retain the shank 54 in the desired position as shown in FIG. 2.

Concurrently, sleeve 19 is drawn to the upward position thereby locking first detent ball 62 in place. However, the rearward movement of sleeve 19 causes all the retractable arms 66 to be dislodged from their respective grooves 64 so that the arms establish radial, rubbing surface with the adjacent walls of casing 12 as sampler 13 is lowered through the casing.

As shown in FIG. 1, after sampler 13 is suspended in place, the pressured source of steam is communicated with the well casing 12 through a cover 23, together with a steam conduit 77 which extends to the pressurized steam source 20.

Sampler 13 is then lowered to the level where steam injection is to be commenced or is taking place. The steam as herein noted, will pass through the length of casing 16 elongated steam passage. An amount of liquid phase steam will thus be formed and collected in reservoir 33, the residual steam will flow into substrate 11.

After a suitable collecting period, sampler 13 is deactivated by tensioning wire line 14 to gradually withdraw the sampler upward through the well casing 12. With one or more, and preferably with all of the retractable arms 66 in contact with an adjacent casing wall, sleeve 19 will be urged into its downward position in abutment with casing shoulder 72.

This downward movement of sleeve 19 will achieve two functions. Initially, it will cause first detent ball 62 to be displaced from its locking position against actuator rod shank 54, thereby releasing the actuator rod 32, to close the two flow control valves.

Secondly, downward movement of sleeve 49 will permit second detent ball 72 to enter the lower detent passage 76, thereby permitting the retractable arms 66 to return to their position within the respective grooves 64. In such condition, sampler 13 can be withdrawn upwardly through casing 12 so that the liquid sample in reservoir 33 can be tested for a determination of the steam quality.

It is understood that although modifications and variations of the invention can be made without departing from the spirit and scope thereof, only such limitations should be imposed as are indicated in the appended claims.

We claim:

1. Steam sampler for collecting the liquid phase component from a pressurized steam flow having liquid and vaporous components, as the latter is passed through a well casing for injection into the substrate contiguous with said casing, said sampler including;

an elongated casing defining a steam flow passage, said casing having an external guide section, and a steam discharge port, flow control valve means in said steam flow passage being operable between fully open and fully closed positions, a valve actuator rod in said flow passage engaging the respective flow control valve means and being operable to actuate the respective valve means between fully open and fully closed positions, a reservoir in said steam flow passage positioned to receive the liquid phase component which separates from the steam flow, a sleeve reciprocally carried on said casing external guide section, being longitudinally displaceable between inner and outer positions, at least one arm engaged to said sleeve, and having an outer end radially displaceable from the sleeve to contact the well casing wall, first detent means releasably engaging the valve actuator rod to selectively maintain the latter in position to allow steam flow through the steam flow passage, second detent means engaging said sleeve to selectively maintain it in the outer position to hold said at least one arm in an extended position in engagement with the well casing wall, whereby upward movement of the steam sampler through the well casing will urge said sleeve to the inner position to release said second detent means, and discharge the valve actuator rod thereby to close the respective flow control valves and discontinue steam flow through the steam flow passage.

2. In the apparatus as defined in claim 1, wherein the flow control valve means includes at least two longitudinally spaced valves.

3. In the apparatus as defined in claim 1, wherein said flow control valve means includes at least two longitudinally spaced and axially aligned valves in said casing stream flow passage.

4. In the apparatus as defined in claim 1, wherein said valve actuator rod is biased to an advanced position to close the steam flow passage to steam flow.

5. In the apparatus as defined in claim 1, wherein said reservoir is disposed intermediate the respective at least two longitudinally spaced flow control valves.

6. In the apparatus as defined in claim 2, wherein the valve actuator rod includes valve closures positioned to actuate the respective flow control valves between open and closed positions.

7. In the apparatus as defined in claim 1, wherein said valve actuator rod includes an enlarged shank segment having a detent groove therein to engage the first detent means.

8. In the apparatus as defined in claim 7, wherein said detent groove extends peripherally about the enlarged shank section.

9. In the apparatus as defined in claim 8, wherein said first detent means includes a detent ball displaceably registered in said detent groove, and maintained therein by engagement with said sleeve.

* * * * *